US010689169B1

(12) United States Patent
Meshberg et al.

(10) Patent No.: US 10,689,169 B1
(45) Date of Patent: Jun. 23, 2020

(54) CHILD-RESISTANT FLIP-TOP CLOSURE AND LOCKING SYSTEM FOR A CONTAINER

(71) Applicant: Packaging Concepts Associates Holding, Inc., Torrington, CT (US)

(72) Inventors: Emil Meshberg, Fairfield, CT (US); Ralph J. DeVito, Oxford, CT (US)

(73) Assignee: PACKAGING CONCEPTS ASSOCIATES HOLDING, INC., Torrington, CT (US)

( * ) Notice: Subject to any disclaimer, the term of this patent is extended or adjusted under 35 U.S.C. 154(b) by 0 days.

(21) Appl. No.: 16/446,084

(22) Filed: Jun. 19, 2019

(51) Int. Cl.
*B65D 50/04* (2006.01)
*B65D 47/08* (2006.01)

(52) U.S. Cl.
CPC ..... *B65D 50/046* (2013.01); *B65D 47/0838* (2013.01)

(58) Field of Classification Search
CPC .. B65D 50/046; B65D 47/0838; B65D 50/06; B65D 47/2006
USPC ..... 215/213
See application file for complete search history.

(56) References Cited

U.S. PATENT DOCUMENTS

| | | | |
|---|---|---|---|
| 3,429,483 | A | 2/1969 | Micallef |
| 3,642,161 | A | 2/1972 | Stroud |
| 3,828,982 | A | 8/1974 | Steigerwald |
| 3,993,209 | A | 11/1976 | Julian |
| 4,024,988 | A | 5/1977 | Starrett |
| 4,513,888 | A | 4/1985 | Curry |
| 4,653,672 | A | 3/1987 | Tuerk et al. |
| 4,773,567 | A | 9/1988 | Stoody |
| 4,821,898 | A | 4/1989 | Smalley |
| 4,865,209 | A | 9/1989 | Bush |
| 5,040,691 | A | 8/1991 | Hayes et al. |
| 5,224,615 | A | 7/1993 | Hickerson |
| 5,282,551 | A | 2/1994 | Pierson |
| 5,379,924 | A | 1/1995 | Taylor |
| 5,379,926 | A | 1/1995 | Mueller et al. |
| 5,402,900 | A | 4/1995 | Glynn |
| 5,458,263 | A | 10/1995 | Ciammitti et al. |

(Continued)

FOREIGN PATENT DOCUMENTS

WO 2018081383 A1 5/2018

OTHER PUBLICATIONS

Bascousa.com, "Life Latch New Generation 2.5 Gallon Plastic Pail with White Screw Top Lid—White", https://web.archive.org/web/20160624 135556/https://bascousa.com/2.5-gallon-pail-with-screw-top-lid.html, Jun. 24, 2016.

(Continued)

*Primary Examiner* — Ernesto A Grano
(74) *Attorney, Agent, or Firm* — Ware, Fressola, Maguire & Barber LLP

(57) ABSTRACT

A child resistant flip top closure system is provided that combines a flip top closure for a container with a child resistant locking mechanism system, which uses an automatic locking element that is depressed to enable a simultaneous rotation of a locking member to transition the flip top from a locked position preventing opening the flip top to dispense any substance in the container to an unlocked position, in which the flip top can be opened to enable dispensing of a substance in the container.

20 Claims, 10 Drawing Sheets

(56) References Cited

U.S. PATENT DOCUMENTS

| | | | | |
|---|---|---|---|---|
| 5,462,182 | A * | 10/1995 | Opresco | B65D 50/046 215/216 |
| 5,520,296 | A | 5/1996 | Freed | |
| 5,628,627 | A | 5/1997 | Fairbanks et al. | |
| 5,702,031 | A | 12/1997 | Meshberg et al. | |
| 5,706,962 | A | 1/1998 | Tauber | |
| 5,772,080 | A | 6/1998 | de Pous et al. | |
| 5,979,681 | A | 11/1999 | Varlet et al. | |
| 6,047,856 | A | 4/2000 | Meshberg et al. | |
| 6,082,564 | A | 7/2000 | Trout | |
| 6,168,035 | B1 | 1/2001 | McLelland | |
| 6,283,333 | B1 | 9/2001 | Knickerbocker et al. | |
| 6,691,896 | B2 | 2/2004 | Meshberg | |
| 6,932,244 | B2 | 8/2005 | Meshberg | |
| 7,168,594 | B2 | 1/2007 | Law et al. | |
| 7,404,495 | B2 | 7/2008 | Keung | |
| 7,434,707 | B2 | 10/2008 | Meshberg | |
| 8,002,149 | B2 | 8/2011 | Leonard | |
| 8,251,251 | B2 * | 8/2012 | Arvidsson | B65D 50/06 220/813 |
| 8,251,252 | B2 * | 8/2012 | Giraud | B65D 50/061 215/24 |
| 8,267,265 | B2 | 9/2012 | Giraud | |
| 8,292,101 | B1 | 10/2012 | Bragg et al. | |
| 8,333,288 | B2 | 12/2012 | Miller et al. | |
| 8,453,873 | B2 | 6/2013 | Zielinski et al. | |
| 8,579,140 | B2 | 11/2013 | Delagrange et al. | |
| 8,777,061 | B1 | 7/2014 | Meshberg | |
| 9,156,597 | B2 | 10/2015 | Letica et al. | |
| 9,889,976 | B2 | 2/2018 | Miller et al. | |
| 2004/0149787 | A1 * | 8/2004 | Englert | B65D 50/06 222/556 |
| 2007/0119870 | A1 | 5/2007 | Lasserre et al. | |
| 2007/0164027 | A1 | 7/2007 | Auer | |
| 2008/0237236 | A1 | 10/2008 | Tanner et al. | |
| 2012/0248129 | A1 * | 10/2012 | Yoshida | B65D 43/0212 220/780 |
| 2016/0068317 | A1 | 3/2016 | Petit | |
| 2017/0066575 | A1 | 3/2017 | Leopold | |
| 2018/0214894 | A1 | 8/2018 | Meshberg | |
| 2018/0221601 | A1 | 8/2018 | Meshberg | |
| 2018/0229903 | A1 | 8/2018 | Lee et al. | |

OTHER PUBLICATIONS

Amazon.com "Contigo Glass Water Bottle with a Quick-Twist Lid, 20oz, Blue Corn", https://www.amazon.com/Contigo-Glass -Water-Bottle-Quick-Twist/dp/B078D68N1G, Dec. 5, 2017.

Greenrushpackaging.com, 13 Dram translucent child resistant pop-top bottles, Apr. 24, 2019.

U.S. Appl. No. 16/443,176, "Child Resistant Disk-Top Closure and Locking System," filed Jun. 17, 2019.

* cited by examiner

CHILD-RESISTANT FLIP-TOP CLOSURE AND LOCKING SYSTEM FOR A CONTAINER

FIELD OF THE INVENTION

The present application relates to child-resistant closure and locking devices for containers, and in particular, a child-resistant flip-top closure and locking device for a container.

BACKGROUND OF THE INVENTION

A typical standard flip-top closure device for a container or a bottle is comprised of one molded part, which functions as two separate parts that are hinged together with an integral living hinge construction. One half of the flip top functions as the lower body of the closure to fit to a bottle or container that can be filled with a substance, and provide a sealable dispense orifice for the container. The other half of the flip top functions as a hinged cap with a seal stud to engage, close and seal the dispense orifice. The cap may also have a protruding tab across from the hinge, to allow the user to pull the cap open from a closed position. Typical flip-top closures do not have any child-resistant properties that would prevent a child from easily opening the top and accessing the substance in the container.

SUMMARY OF THE INVENTION

The present application relates to a new child resistant flip-top closure and locking device that combines the standard function of a flip-top closure and a child resistant system that uses an automatic locking element, which requires a rotation of a part from an open-disabled position to an open-enabled position after unlocking the locking element. The child resistant flip top closure system includes a closure body and a hinged flip-top.

The closure body has a lower area which engages the neck of a container. The closure body may include a valve style sealing fit to the inside diameter of the container neck, and a horizontal top wall which closes off the container opening. A downward cylindrical skirt includes internal undercut features which engage the container neck to keep the closure body captive to the container neck. The top surface of the horizontal wall has an upward cylindrical post, which has a centrally located through-hole, which acts as a dispense port for a substance in the container. About the post is an undercut snap feature to engage the flip-top, and allow its rotation within a controlled angle, while staying captive to the closure body. The cylindrical post is situated on a central vertical axis of the container neck.

The closure body has a cylindrical outer wall, concentric with the central axis and post. The outer wall may be a single wall design, with a shaped recess cut-out in a front area of the closure body. The height of the outer wall is tall enough to extend above a tab area of the flip top cap. A rear area of the outer wall opposite the recess has a second cut-out area for clearance to allow the upper half of the flip-top to rotate to the open position. One or more stopping ribs inside the outer wall to constrain the rotation of the flip-top to within a certain fixed angle.

The flip-top includes a lower body section and an upper cap section. The lower body section is circular and sized to fit within the closure body's cylindrical outer wall. The body section has a horizontal floor with a concentric through hole. The through hole is sized to fit about the cylindrical post of the closure body and has an edge feature to work with the undercut snap feature on the closure body, such that the flip-top can rotate radially relative to the closure body yet remain captive axially. The lower cylindrical edge of the part has cut out features to engage the closure body stopping ribs during rotation. The lower front area has a horizontal, cantilevered, flex tab with a leading edge and protruding button.

The upper cap section of the hinged flip-top may be shaped as a typical flip-top upper half, but having a tab at the front edge that is larger and protrudes further from the front edge of the cap. The hinged area between body and cap sections may be of a thin web style, which allows the upper portion to hinge-over and be closed on the lower portion, or rotate and snap to an open position. Centered on an inner surface of the cap is a cylindrical stud seal, which fits into and seals the dispense orifice on the closure body when in the closed position.

When the flip-top is closed and locked, the cap tab is horizontal and within the front cut out area of the closure body. The cut-out area has a horizontal slot extending horizontally in one direction, sized to match the profile of the cap tab. In the locked position, the cap tab is within the slot, and the flip-top body is locked from rotating to the open position, relative to the closure body. The cantilevered tab and button edge of the flip-top is positioned against the inside edge of the front recess, in the opposite direction from the slot, locking the flip-top between the slot end wall in one direction, and the vertical cut out wall surface in the other direction. When in this position, the flip-top cap cannot be rotated upwards to open and expose the dispense orifice. The cap tab is inside the body slot, and the slot upper wall is over the tab, so the tab is captive.

By pressing the button of the cantilevered tab inwardly, the leading edge of the cantilevered tab is pushed past the vertical cut-out sidewall. The closed flip-top closure can then be rotated radially in the direction away from the slot to allow the cap tab to come out of the slot and move into the main central cut-out area. The cap tab can then be lifted upwardly, and the flip-top cap can then be opened like a typical flip-top cap.

After use, to re-lock the flip top and container, the flip-top cap is rotated about the hinge to the closed position, the cap stud is engaged within the dispense orifice to shut and seal the orifice. The closed flip-top is then rotated radially, and the cap tab reenters the slot and stops against the end wall of the slot. The cantilevered button is now beyond the cut-out vertical wall edge, such that it moves outwardly due to the spring bias of the flexed cantilever arm. The button side edge is now in line with the cut-out sidewall, so that the flip-top part is locked from radial rotation, and the cap tab is within the slot, locking the cap top from any movement or rotation.

The flip-top closure is able to rotate about a fixed axle dispense port on a container, and be automatically locked in a dispense-disabled position or rotated to a dispense-enabled position after the locking tab is depressed. The inability of a small child to first depress the lock button, then rotate the lock to the open position to make this closure child resistant.

In accordance with a first aspect of the application, a closure system for a dispensing container is provided. The closure system comprises a body member comprising: an outer wall comprising a first vertical edge formed in the outer wall and comprising a horizontal slot formed therethrough, and a recess formed in the outer wall adjacent to the first vertical edge; and a hollow passageway formed through the body member. The closure system further comprises a rotating closure member comprising: a lower section configured to be secured to the body member and comprising a central opening and a cantilevered tab comprising a locking edge, which in a locked configuration, abuts a second vertical edge defined by the recess of the body member configured to prevent rotation of the rotating locking member; an upper section configured to cover the central opening and the hollow passageway in a closed configuration and comprising a protruding tab; and a hinge connecting the lower section and the upper section in a manner that enables opening the rotating closure member to an open configuration, wherein the protruding tab is at least partly received in the slot of the body member in the locked configuration and the slot prevents vertical movement of the protruding tab and opening of the rotating closure member; wherein the cantilevered tab is configured to be flexed inwardly to dispose the locking edge within the outer wall of the body member and out of abutment with the vertical edge to enable the rotation of the rotating closure member in a first axial direction to an unlocked configuration; and wherein in the unlocked configuration, the protruding tab is disposed over the recess and out of the slot of the body member to enable the vertical movement of the protruding tab to open the rotating closure member to the open configuration.

In accordance with an embodiment of the closure system of the first aspect of the application, the body member further comprises a post disposed within the outer wall, and the hollow passageway extends through the post.

In accordance with a further embodiment of the closure system of the first aspect of the application, which may be in addition to or an alternative to any one or more of the above-identified embodiments of the closure system, the post comprises a circumferential bead configured to engage a lip extending from an inner circumferential wall of the central opening of the lower section of the rotating closure member.

In accordance with a further embodiment of the closure system of the first aspect of the application, which may be in addition to or an alternative to any one or more of the above-identified embodiments of the closure system, the upper section of the rotating closure member further comprises a sealing member configured to engage the post in the closed configuration to seal the hollow passageway.

In accordance with a further embodiment of the closure system of the first aspect of the application, which may be in addition to or an alternative to any one or more of the above-identified embodiments of the closure system, the body member comprises an inner wall configured to be removably connected to the dispensing container.

In accordance with a further embodiment of the closure system of the first aspect of the application, which may be in addition to or an alternative to any one or more of the above-identified embodiments of the closure system, the rotating closure member is configured to be rotated axially about the post approximately 30° between the locked configuration and the unlocked configuration.

In accordance with a further embodiment of the closure system of the first aspect of the application, which may be in addition to or an alternative to any one or more of the above-identified embodiments of the closure system, the rotating closure member is configured for rotation in a second axial direction opposite the first axial direction from the unlocked to the locked configuration.

In accordance with a further embodiment of the closure system of the first aspect of the application, which may be in addition to or an alternative to any one or more of the above-identified embodiments of the closure system, the body member further comprises a plurality of stopping ribs, wherein during rotation of the rotating closure member in the first axial direction, the a first edge of the rotating closure member is configured to contact a first of the plurality of stopping ribs to prevent further rotation of the rotating closure member in the first axial direction, and wherein during rotation of the rotating closure member in the second axial direction, a second edge of the rotating closure member is configured to contact a second of the plurality of stopping ribs to prevent further rotation of the rotating closure member in the second axial direction.

In accordance with a further embodiment of the closure system of the first aspect of the application, which may be in addition to or an alternative to any one or more of the above-identified embodiments of the closure system, the outer wall of the body member further comprises a clearance opposite the recess, and the hinge is disposed in the clearance.

In accordance with a further embodiment of the closure system of the first aspect of the application, which may be in addition to or an alternative to any one or more of the above-identified embodiments of the closure system, the outer wall of the body member extends around the circumference of the body member.

In accordance with a further embodiment of the closure system of the first aspect of the application, which may be in addition to or an alternative to any one or more of the above-identified embodiments of the closure system, the cantilevered tab is biased outwardly away from a center of the rotating closure member.

In accordance with a further embodiment of the closure system of the first aspect of the application, which may be in addition to or an alternative to any one or more of the above-identified embodiments of the closure system, the body member further comprises an inner wall and a gap formed between the outer wall and the inner wall; and the rotating locking member comprises an arm having the cantilevered tab formed thereon configured to be received in the gap.

In accordance with a further embodiment of the closure system of the first aspect of the application, which may be in addition to or an alternative to any one or more of the above-identified embodiments of the closure system, the body member comprises an inner wall having the post extending therefrom, the inner wall comprises a shoulder adjacent to the post, and the lip on the inner circumferential wall of the central opening of the lower section of the rotating closure member is configured to be engaged between the circumferential bead of the post and the shoulder.

In accordance with a second aspect of the application, a dispensing container for a substance is provided, comprising a closure system. The closure system comprises a body member comprising: an outer wall comprising a first vertical edge formed in the outer wall and comprising a horizontal slot formed therethrough, and a recess formed in the outer wall adjacent to the first vertical edge; and a hollow passageway formed through the body member in communication with a chamber of the dispensing container comprising the substance. The closure system further comprises a rotating closure member comprising: a lower section configured to be secured to the body member and comprising a central opening and a cantilevered tab comprising a locking edge, which in a locked configuration, abuts a second vertical edge defined by the recess of the body member configured to prevent rotation of the rotating locking member; an upper section configured to cover the central opening and the hollow passageway in a closed configuration and comprising a protruding tab; and a hinge connecting the lower section and the upper section in a manner that enables opening the rotating closure member to an open configuration; wherein the protruding tab is at least partly received in the slot of the body member in the locked configuration and the slot prevents vertical movement of the protruding tab and opening of the rotating closure member; wherein the cantilevered tab is configured to be flexed inwardly to dispose the locking edge within the outer wall of the body member and out of abutment with the vertical edge to enable the rotation of the rotating closure member in a first axial direction to an unlocked configuration; and wherein in the unlocked configuration, the protruding tab is disposed over the recess and out of the slot of the body member to enable the vertical movement of the protruding tab to open the rotating closure member to the open configuration.

In accordance with an embodiment of the dispensing container of the second aspect of the application, the dispensing container comprises a neck configured to be received in the hollow passageway of the body member and comprising an external, circumferential bead, and the body member comprises one or more locking elements configured to engage the circumferential bead on the neck to secure the closure system to the dispensing container.

In accordance with a further embodiment of the dispensing container of the second aspect of the application, which may be in addition to or an alternative to one or more of the above-identified embodiments of the dispensing container, the one or more locking elements are disposed on an inner wall of the body member which is spaced apart from the outer wall of the body member.

In accordance with a further embodiment of the dispensing container of the second aspect of the application, which may be in addition to or an alternative to one or more of the above-identified embodiments of the dispensing container, the body member comprises an annular sealing member disposed within the inner wall that is configured to be received within the neck of the dispensing container.

In accordance with a further embodiment of the dispensing container of the second aspect of the application, which may be in addition to or an alternative to one or more of the above-identified embodiments of the dispensing container, the rotating closure member is configured to be rotated axially about the post approximately 30° between the locked configuration and the unlocked configuration.

In accordance with a further embodiment of the dispensing container of the second aspect of the application, which may be in addition to or an alternative to one or more of the above-identified embodiments of the dispensing container, the rotating closure member is configured for rotation in a second axial direction opposite the first axial direction from the unlocked configuration to the locked configuration.

In accordance with a further embodiment of the dispensing container of the second aspect of the application, which may be in addition to or an alternative to one or more of the above-identified embodiments of the dispensing container, the cantilevered tab is biased outwardly away from a center of the rotating closure member and into the recess upon rotation from the unlocked configuration to the locked configuration.

DETAILED DESCRIPTION OF THE INVENTION

Figures 1A, 1B, 1C:
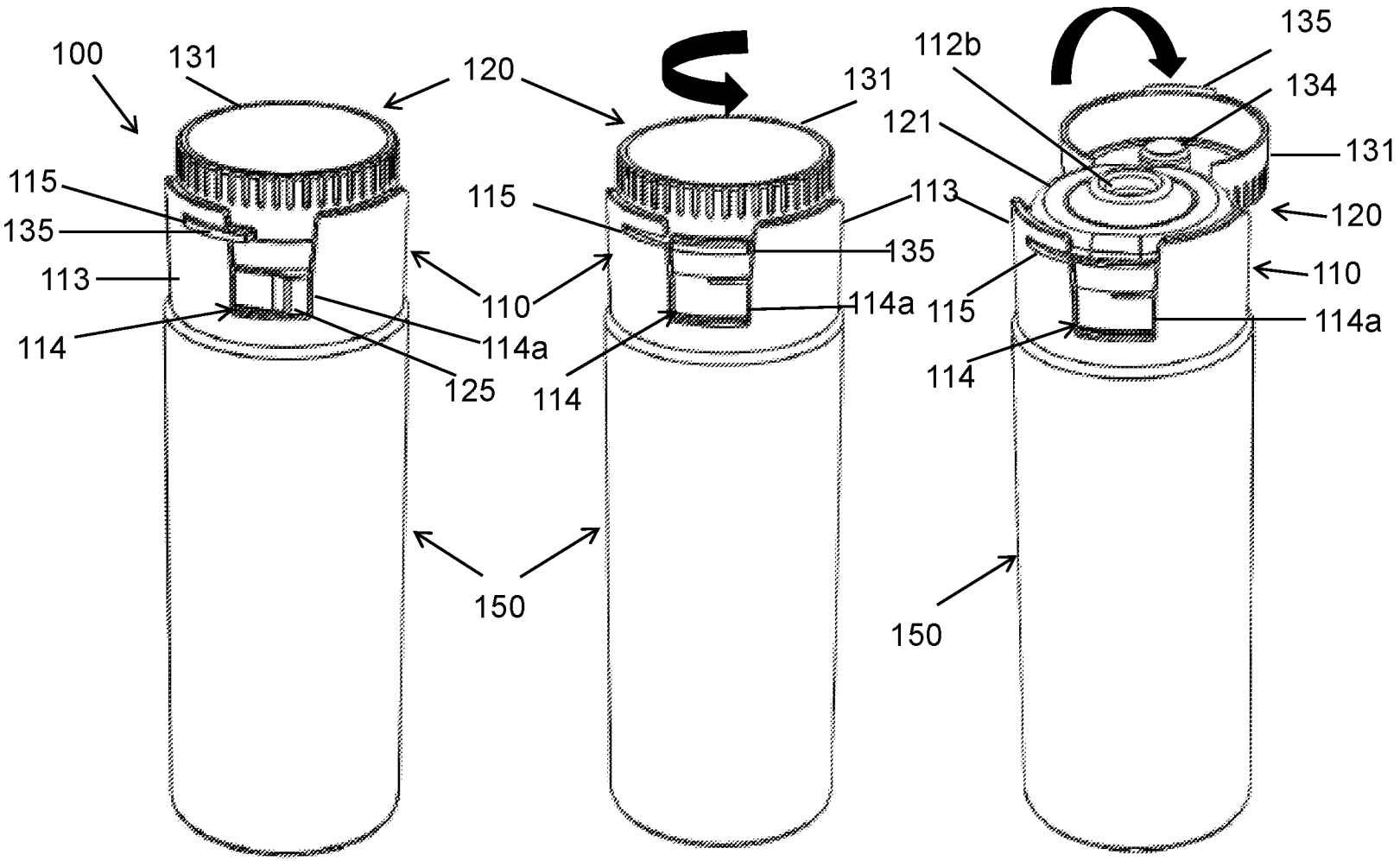
FIG. 1A shows a front perspective view of a dispensing container comprising a flip-top closure system in a locked configuration, in accordance with an embodiment of the present application.
FIG. 1B shows a front perspective view of the dispensing container comprising the flip-top closure system in an unlocked and closed configuration, in accordance with an embodiment of the present application.
FIG. 1C shows a front perspective view of the dispensing container comprising the flip-top closure system in an unlocked and open configuration, in accordance with an embodiment of the present application.

The closure system of the present application will be described with reference to FIGS. 1A-5B.

A child resistant ("CR") safety closure system 100 in accordance with the present application includes a flip-top closure for a container 150 and a CR system for safety, which uses an automatic locking element and requires a rotation of parts from a dispense-disabled position, to a dispense-enabled position after unlocking. The CR closure system 100 comprises a main, closure body member 110 and a rotating flip-top closure member 120.

The closure body member 110 acts as a means of attachment of the closure system 100 to the container 150 and comprises a single through hole 112*b* serving as a dispenser from the container 150, and which also is part of a standing axle perpendicular to a plane. The closure body member 110 includes a floor 111 having an inner wall 112 and an outer wall 113 extending vertically therefrom. The inner wall section 112 is dimensioned to fit over a dispensing orifice 151 of the container 150, and to engage a neck 152 of the container orifice 151. In the embodiment illustrated in the Figures, one or more locking elements 118 are arranged circumferentially within the inner wall 112, which can be one or more projections extending out from the inner wall 112, that may snap over and engage a circumferential bead 153 on the neck 152 of the dispensing orifice 151. The closure body member 110 can be secured to the container 150 using alternative mechanisms that retain the "child-resistant" nature of the dispensing container, including for example with internal threading inside the inner wall 112 to engage a threaded dispensing orifice 151, which may further comprises locking teeth on the bottom of a screw thread that "lock" with corresponding teeth on the shoulder of the container 150, or floating teeth, wherein one must push down on the closure system 100 in order to engage the teeth on bottom of a screw thread with corresponding teeth on shoulder of container 150.

The inner wall 112 of the closure body member 110 includes a post 112*a* extending vertically therefrom. A through hole 112*b* is disposed atop the post 112*a*, which serves as a dispenser and forms a passageway in fluidic communication with the dispensing orifice 151 of the container 150 when the closure body member 110 is affixed to the container 150. An annular seal 119 may also be provided on the reverse side of an upper surface of the post 112*a* and within the inner wall 112 and post 112*a* that is dimensioned to be received within the neck 152 of the dispensing orifice 151 to provide a seal around the dispensing orifice 151. The annular seal 119 prevents the contents in the container 150 from being dispensed into a space between the neck 152 of the container 150 and the underside of the closure body member 110, or leaking out from this space. The post 112*a* may also include a protruding annular bead 112*c* around its circumference, which is configured to engage the flip-top member 120 between the bead 112*c* and a shoulder member 112*e*, to secure the closure body member 110 to the flip-top member 120 in such a manner that the flip-top member 120 can axially rotate about the closure body member 110, which is in a fixed position secured to the container 150.

The closure body member 110 further includes an outer wall 113 spaced apart from the inner wall 112 by the floor 111 with a gap formed between walls 112, 113. The outer wall 113 includes a substantially U-shaped recess 114 cutout of the wall 113, which is defined on one end by a first vertical edge 114*a* and on another, opposing end by a second vertical edge 114*b*, with a horizontal edge 114*c* formed between and at the base of the two vertical edges 114*a*, 114*b*. The recess 114 is configured to receive a cantilevered tab 125 of the flip-top member 120 when the closure system 100 is in a locked configuration. A slot 115 is provided in the outer wall 113 formed in the vertical edge 114*b* of the recess 114. The slot 115 is dimensioned to receive a tab 135 of the flip-top member 120 and block vertical movement of the tab 135, as described in further detail below. Opposite the recess 114, a clearance area 116 is formed in the outer wall 113, which is configured to receive a hinged area 130 of the flip-top member 120 and allow limited axial rotation of the hinge 130.

The closure system 100 further includes a flip-top member 120, which encloses the container 150 and includes a locking element, which in combination with the closure body member 110, lock the container 150 closed in a child resistant manner. The flip-top member 120 includes a base portion 121 and an upper lid or cap portion 131, which are connected by a hinge 130. In a typical configuration, the lid portion 131 engages the base portion 121 to close the flip-top member 120, and the lid portion 131 can be disengaged from the base portion 121 and rotated about the hinge 130, as shown in FIG. 1C for example, to open the flip-top member 120.

The flip-top member 120 base portion 121 includes an outer wall 123 with a rim 124 disposed atop the outer wall 123, which surrounds a central opening 122. The central opening 122 of the base portion 121 is dimensioned to receive the post 112*a* of the closure body member 110 within the central opening 122. An inner surface 124*a* of the rim 124 includes a projecting lip 124*b* around the circumference of the central opening 122 that is configured to engage the circumferential bead 112*c* of the post 112*a*. The lip 124*b* is secured between the circumferential bead 112*c* and the shoulder 112*e* of the post 112*a* to secure the flip-top member 120 to the closure body member 110 in a manner that permits axial rotation of the flip-top member 120 about the central opening 122 and post 112*a*/through hole 112*b*. When the flip-top member 120 and closure body member 110 are secured together, the outer wall 123 of the base portion 121 is disposed in between the inner wall 112 and outer wall 113 of the closure body member 110.

The base portion 121 of the flip-top member 120 also includes an integral locking feature, which includes a cantilevered tab 125 which can be depressed or flexed from the at-rest/locked state, to the unlocked state, which then allows the rotation of the flip-top member 120. The base portion 121 of the flip-top member 120 includes an arm 126 that extends from the outer wall 123, in a direction opposite from the rim 124, and the cantilevered tab 125 is arranged at one end of the arm 126. The cantilevered tab 125 is biased outwardly from the center of base portion 121 at rest, and when the flip-top member 120 and closure body member 110 are secured together in a first, locked configuration, the cantilevered tab 125 extends into the recess 114 in the outer wall 113 of the closure body member 110. An edge 125*a* of the locking cantilevered tab 125 is concentric and interferes with one of the vertical edges 114*a* in the recess 114 on the closure body member 110 at rest, such that the flip-top member 120 cannot rotate relative to closure body member 110. Once the cantilevered tab 125 is depressed and the two interfering edges (125*a*, 114*a*) no longer interfere, the flip-top member 120 can be rotated relative to the closure body member 110.

The lid portion 131 of the flip-top member 120 is affixed to the base portion 121 by the hinge 130. The lid portion 131 includes a top surface 132 that covers the through hole 112*b* of the closure body member 110 and the dispensing orifice 151 of the container 150, and a circumferential wall 133 which extends down from the top surface 132. The underside of the top surface 132 of the lid portion 131 includes a seal 134 that aligns with the through hole 112*b* of the closure body member 110 and seals the through hole 112*b* and the dispensing orifice 151 of the container 150 when the flip-top member 120 is closed, to prevent the substance in the container 150 from being dispensed into the lid portion 131 when the container is closed (i.e., into the space within the circumferential wall 133 and top surface 132). The seal 134 is disposed over a lip 112*d* arranged on an inner diameter of the through hole 112*b*.

The lid portion 131 further includes a tab 135, which aids a user in opening the flip-top member 120 by providing a projecting structural element that can be used as a lever for rotation of the lid portion 131 into the open configuration. In the closure system 100 described herein, the tab 135 further serves as a locking mechanism to prevent the closure system 100 and container 150 from being opened. In the locked configuration, the tab 135 is disposed at least partly within the slot 115 in the outer wall 113 of the closure body member 110. The slot 115 constrains any vertical movement of the tab 135, which prevents the lid portion 131 from rotating into the open position. In order to open the flip-top member 120, the tab 135 has to be rotated axially out of engagement with the slot 115 by depressing the cantilevered tab 125 and rotating the flip-top member 120 as described below, so that the tab 135 is disposed between the two vertical edges 114*a*, 114*b* of the recess 114.

Figure 2A:
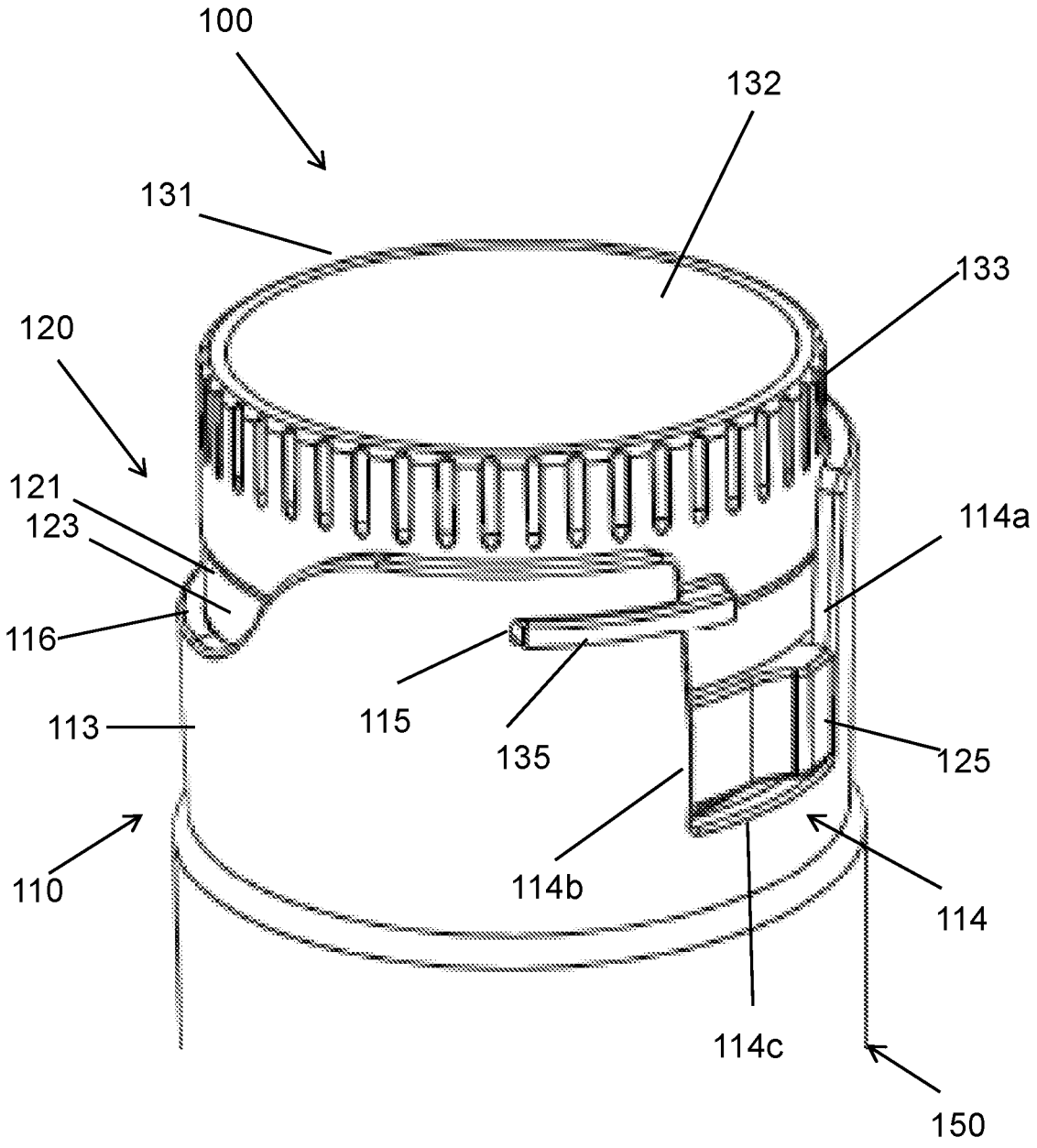
FIG. 2A shows a front perspective view of a flip-top closure system in a locked configuration, in accordance with an embodiment of the present application.

FIGS. 1A and 2A show various views of the closure system 100 and container 150 in the locked and closed configuration.

The cantilevered tab 125 of the flip-top member 120 is disposed within the recess 114 of the outer wall 113 of the closure body member 110 when the closure system 100 is in the locked configuration. The recess 114 in the outer wall 113 can be substantially U-shaped, with a first vertical edge 114*a* on one side of the recess 114 and a second vertical edge 114*b* on an opposing side of the recess 114. At rest, the cantilevered tab 125 is biased outwardly (i.e., away from the center of the flip-top member 120) and extends into the recess 114. An outwardly protruding edge 125*a* of the cantilevered tab 125 engages the first vertical edge 114*a* of the recess 114. This engagement prevents the flip-top member 120 from being able to axially rotate in a direction that would disengage the tab 135 of the lid portion 131 and the slot 115 and reposition the tab 135 over the recess 114 of the outer wall 113 of the closure body member 110. The cantilevered tab 125 can be flexed inwardly by depressing the cantilevered tab 125 at or near the outwardly protruding edge 125*a*, which repositions the protruding edge 125*a* within the outer wall 113 of the closure body member 110 and disengages the protruding edge 125*a* with the vertical edge 114*a*. A button may extend from the surface of the cantilevered tab 125 that can be depressed to push the cantilevered tab 125 inward. When the cantilevered tab 125 is disengaged from the vertical edge 114*a*, the base portion 121 and connected lid portion 131 can be rotated approximately 30 degrees from the locked configuration to the unlocked configuration. In certain embodiments of the closure system 100, as shown for example in FIG. 3D, the closure body member 110 may comprise a pair of stopping ribs 117 arranged between the outer wall 113 and the inner wall 112, which are each configured to engage one of two vertical edges 127 on an end of the arm 126 opposite the cantilevered tab 125 and/or on an extension from the base of the outer wall 123 of the base portion 121 of the flip-top member 120. Each stopping rib 117 is configured to engage a vertical edge 127 when the flip-top member 120 is rotated in one of the two axial directions (i.e., in a first direction to unlock the closure system 100 and a second direction to relock the closure system 100), so that axial rotation of the flip-top member 120 relative to the closure body member 110 is constrained. In order to unlock the closure system 100, the cantilevered tab 125 of the flip-top member 120 must be pressed and the flip-top member 120 rotated simultaneously.

Figure 2B:
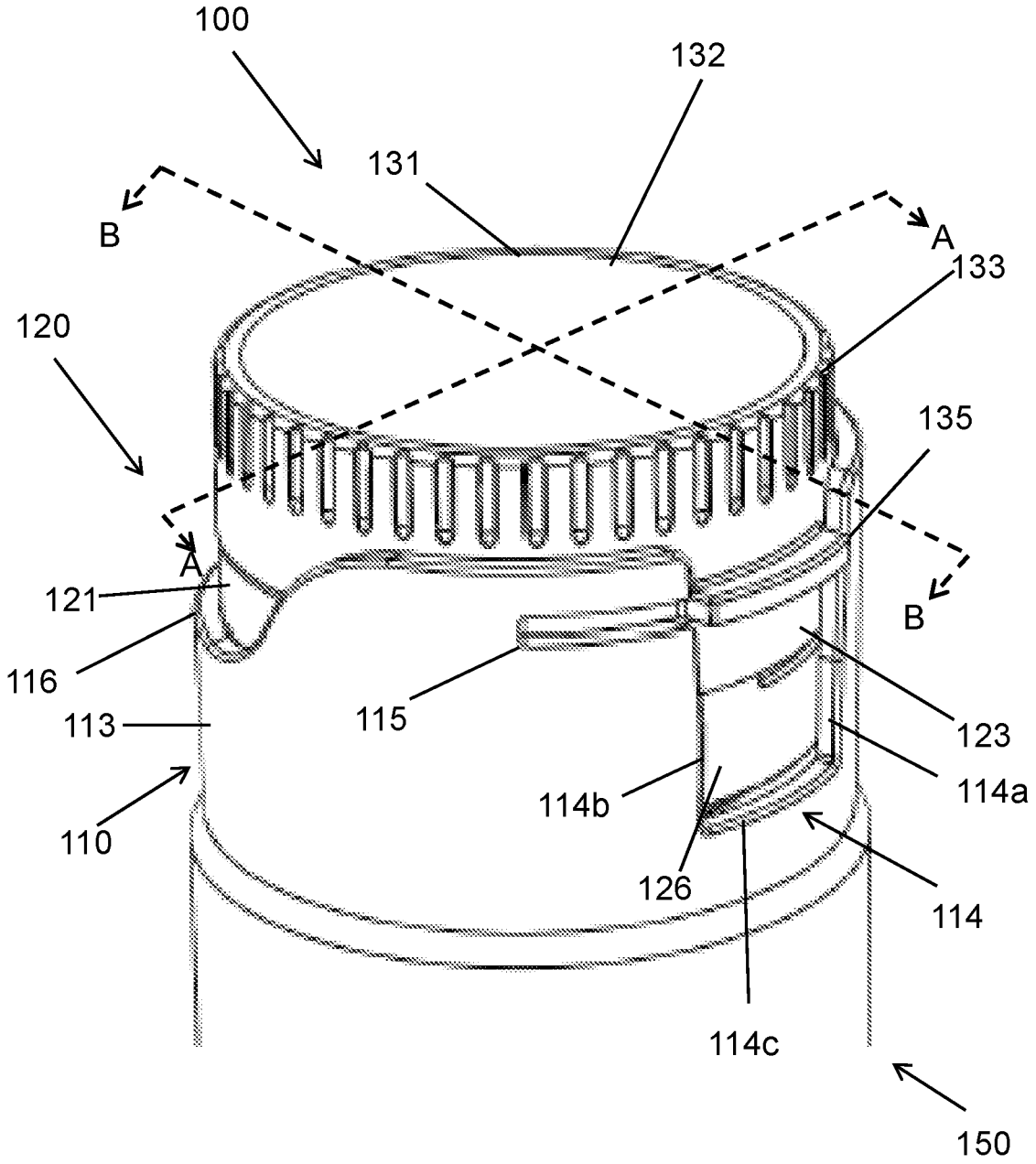
FIG. 2B shows a front perspective view of the flip-top closure system in an unlocked and closed configuration, in accordance with an embodiment of the present application.

FIGS. 1B and 2B show various views of the closure system 100 and container 150 in the unlocked and closed configuration.

In the unlocked configuration, flip-top member 120 has rotated from its position in the locked configuration, and the tab 135 of the lid portion 131 disengaged from the slot 115 of the closure body member 110. The tab 135 is repositioned to be entirely clear of the slot 115, and is disposed over the recess 114 in the outer wall 113 of the closure body member 110. The closure system 100 and the container 150 remain closed in this configuration and unable to dispense the contents of the container 150, but can be opened from this unlocked configuration. The tab 135 of the lid portion 131 can be lifted to pivot the lid portion 131 about the hinge 130 to expose the through hole 112*b* into the dispensing orifice 151 of the container 150.

Figure 2C:
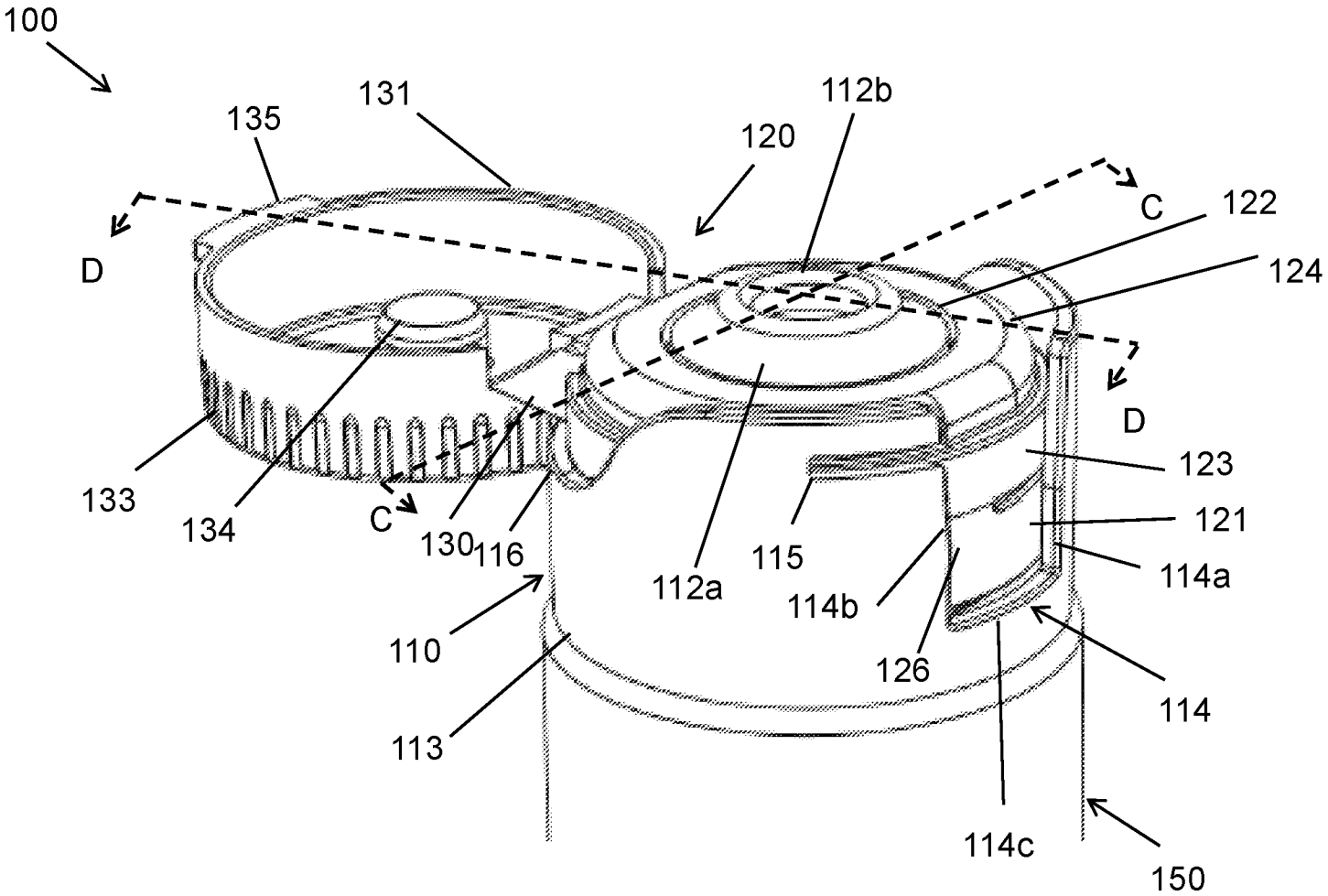
FIG. 2C shows a front perspective view of the flip-top closure system in an unlocked and open configuration, in accordance with an embodiment of the present application.
Figure 3A:
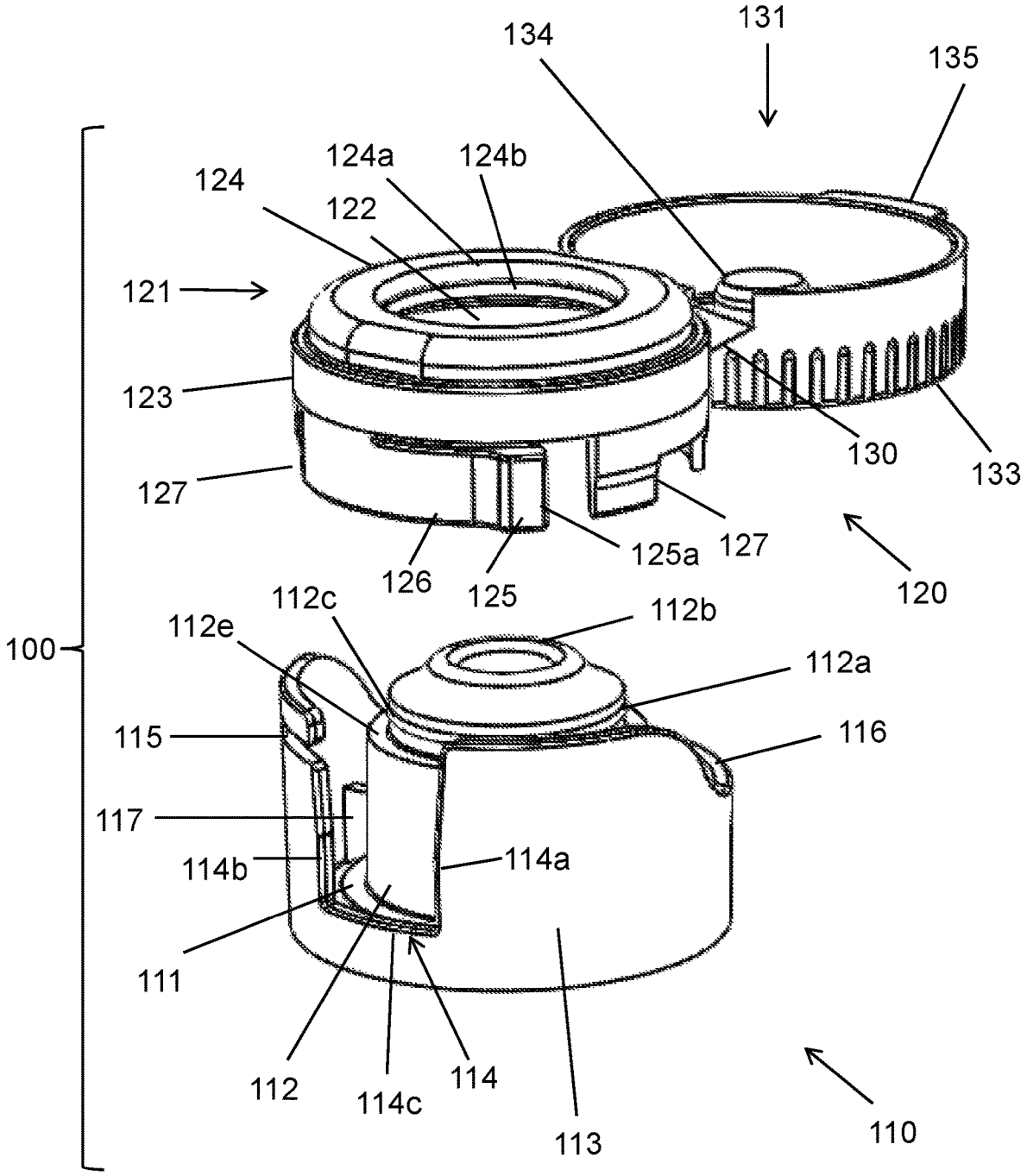
FIG. 3A shows an exploded view of the flip-top closure system, in accordance with an embodiment of the present application.
Figure 3B:
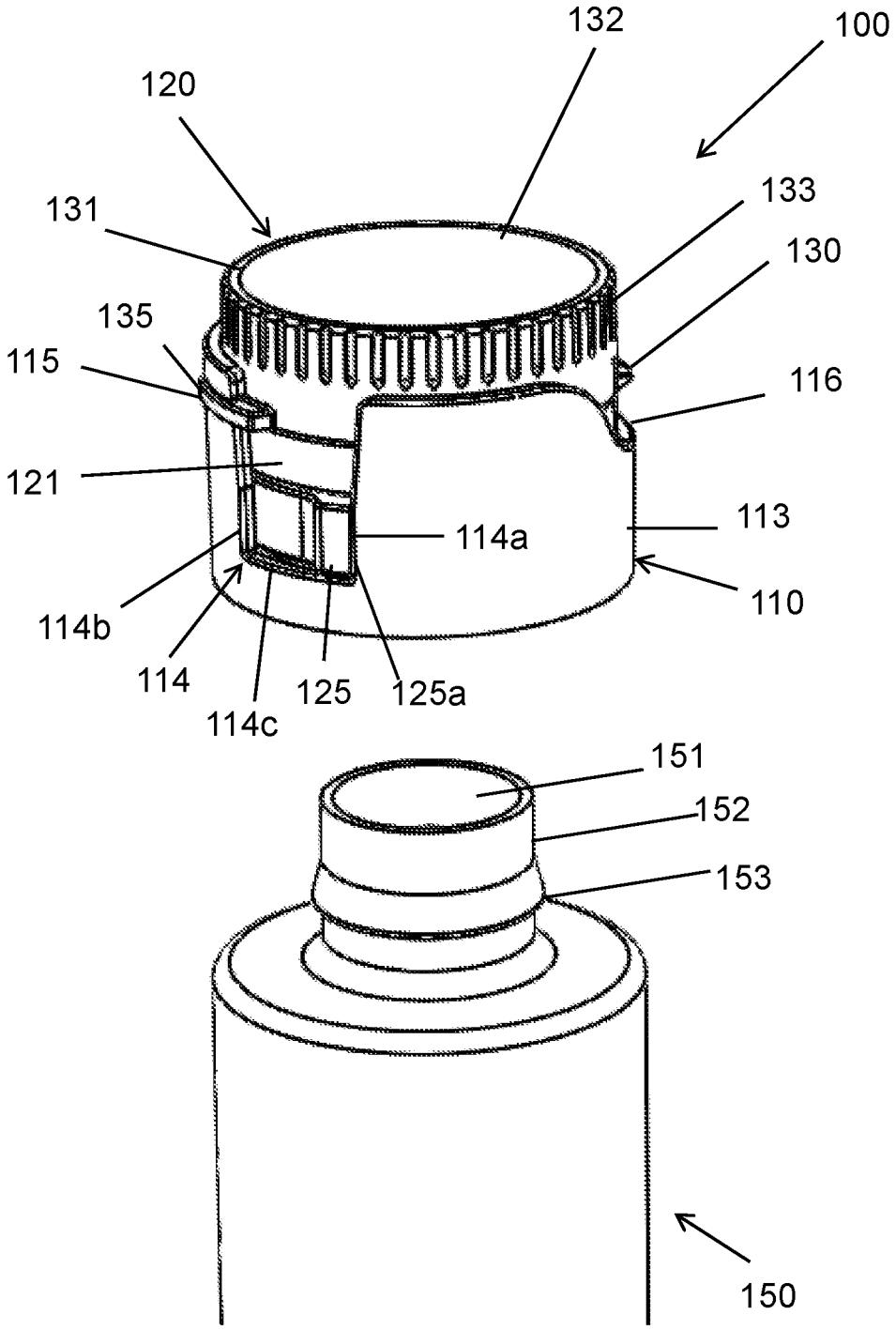
FIG. 3B shows an exploded view of the dispensing container comprising the flip-top closure system, in accordance with an embodiment of the present application.
Figure 3C:
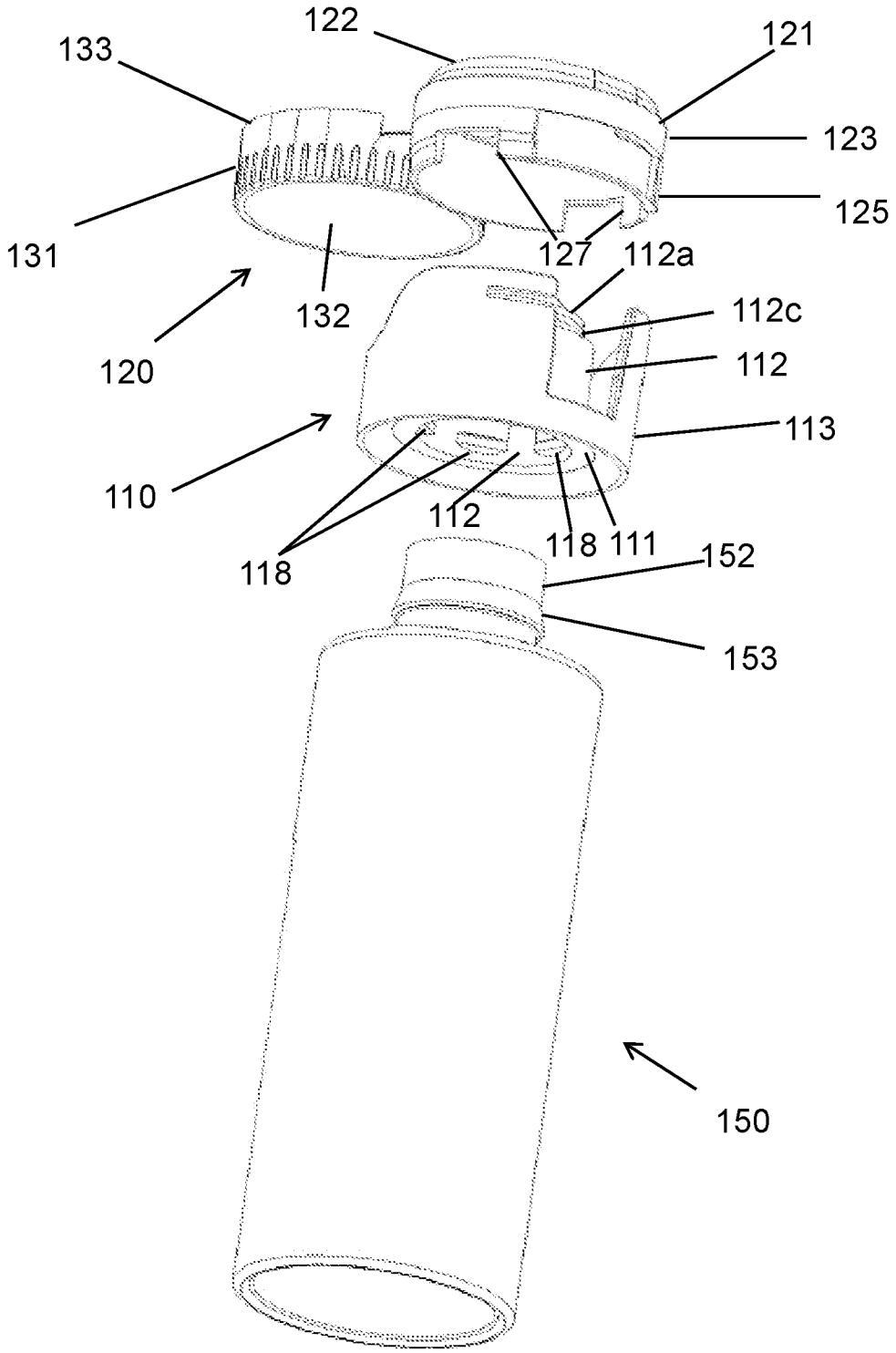
FIG. 3C shows a further exploded view of the dispensing container comprising the flip-top closure system, in accordance with an embodiment of the present application.
Figure 3D:
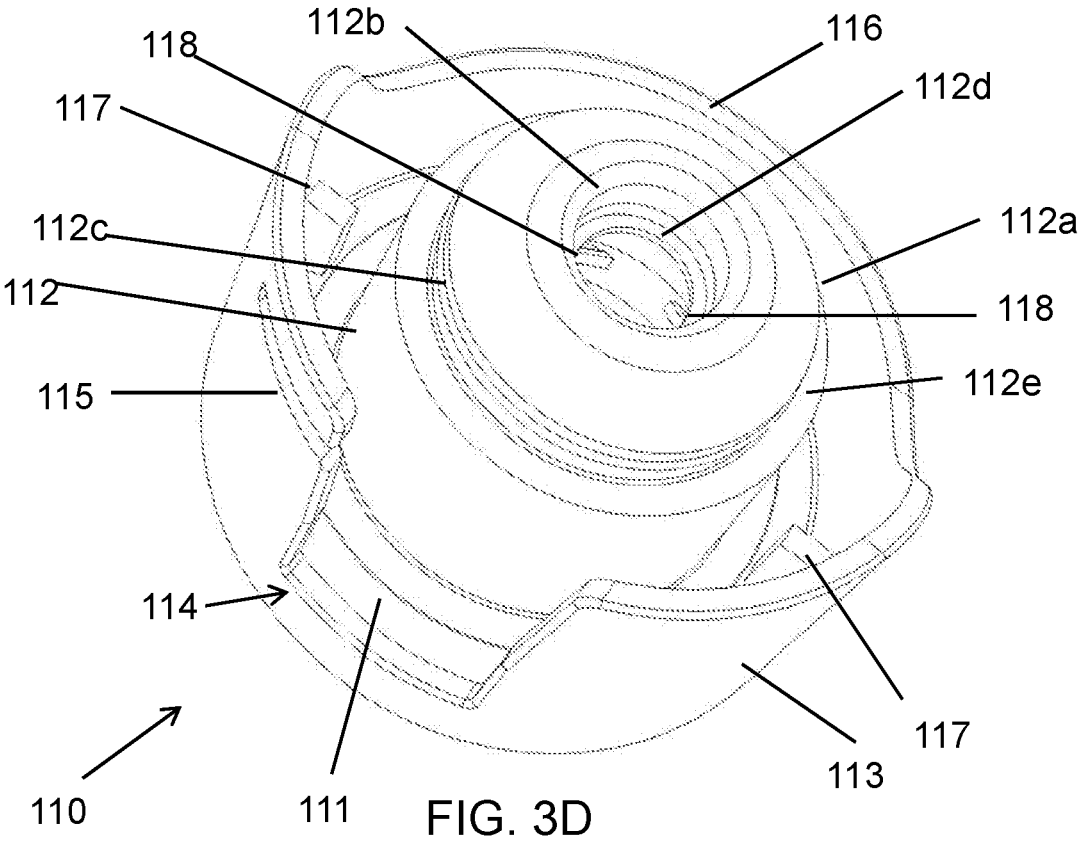
FIG. 3D shows a top perspective view of a closure body member of the flip-top closure system, in accordance with an embodiment of the present application.
Figure 3E:
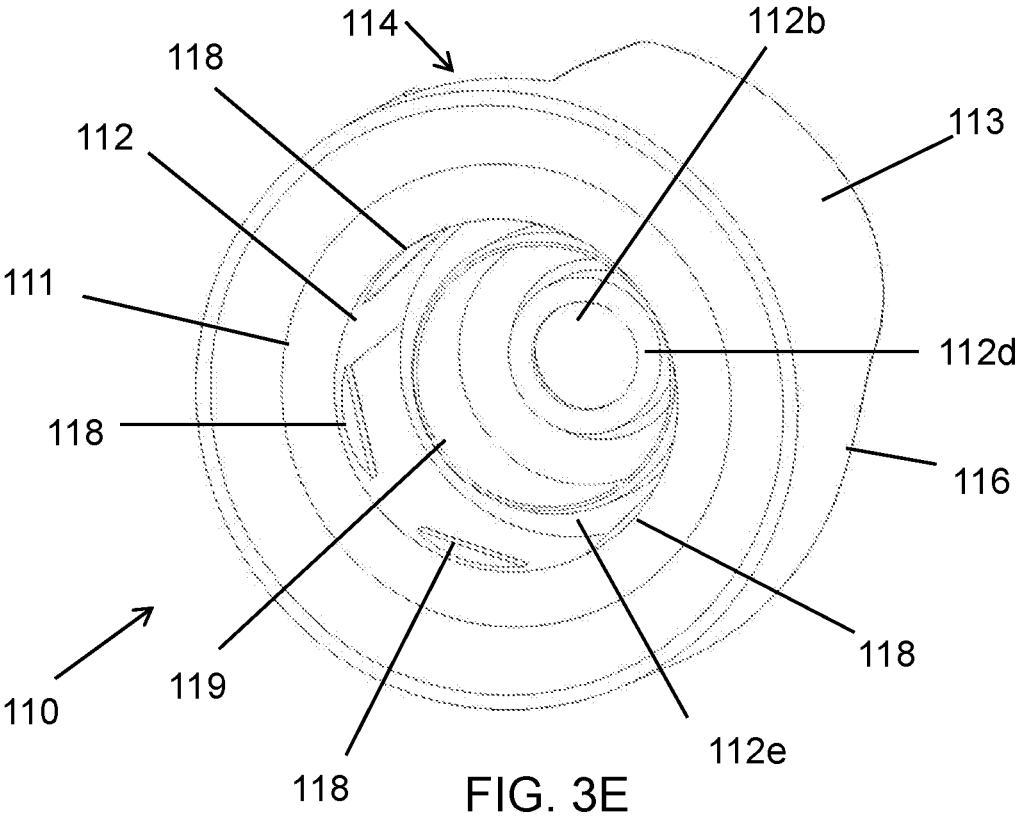
FIG. 3E shows a bottom perspective view of a closure body member of the flip-top closure system, in accordance with an embodiment of the present application.
Figure 4A:
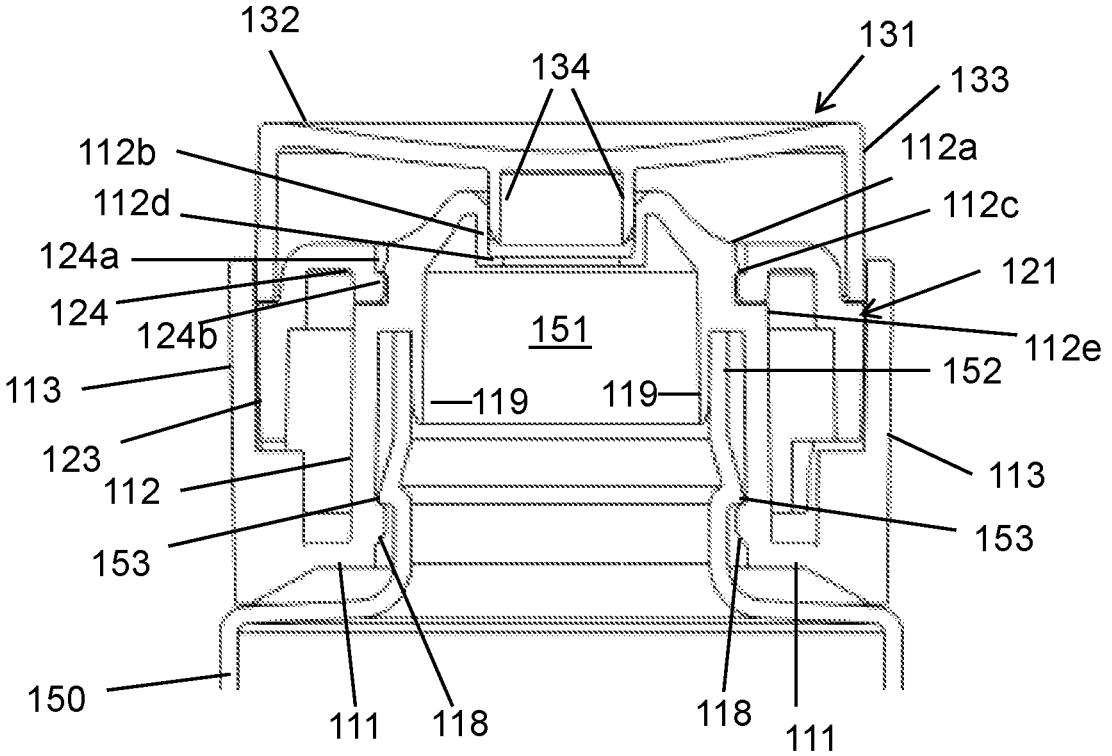
FIG. 4A shows a cross-sectional view of the dispensing container comprising the flip-top closure system in the unlocked and closed configuration along axis A-A, in accordance with an embodiment of the present application.
Figure 4B:
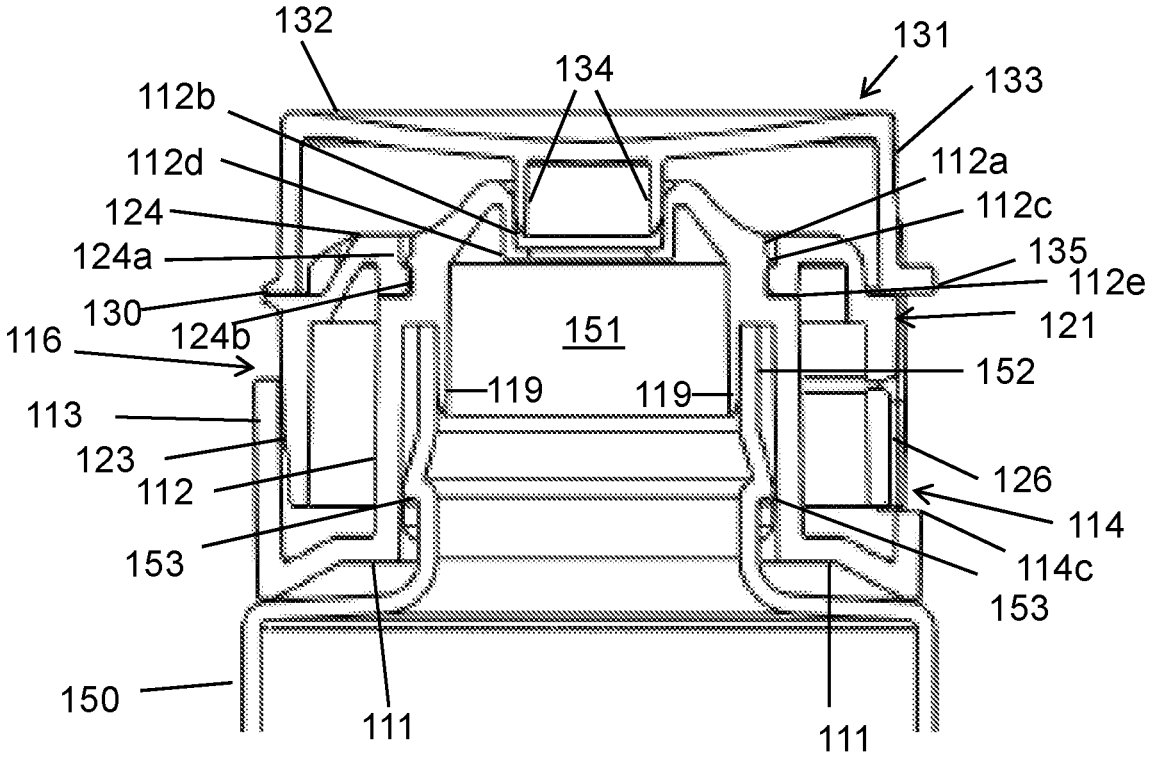
FIG. 4B shows a cross-sectional view of the dispensing container comprising the flip-top closure system in the unlocked and closed configuration along axis B-B, in accordance with an embodiment of the present application.
Figure 5A:
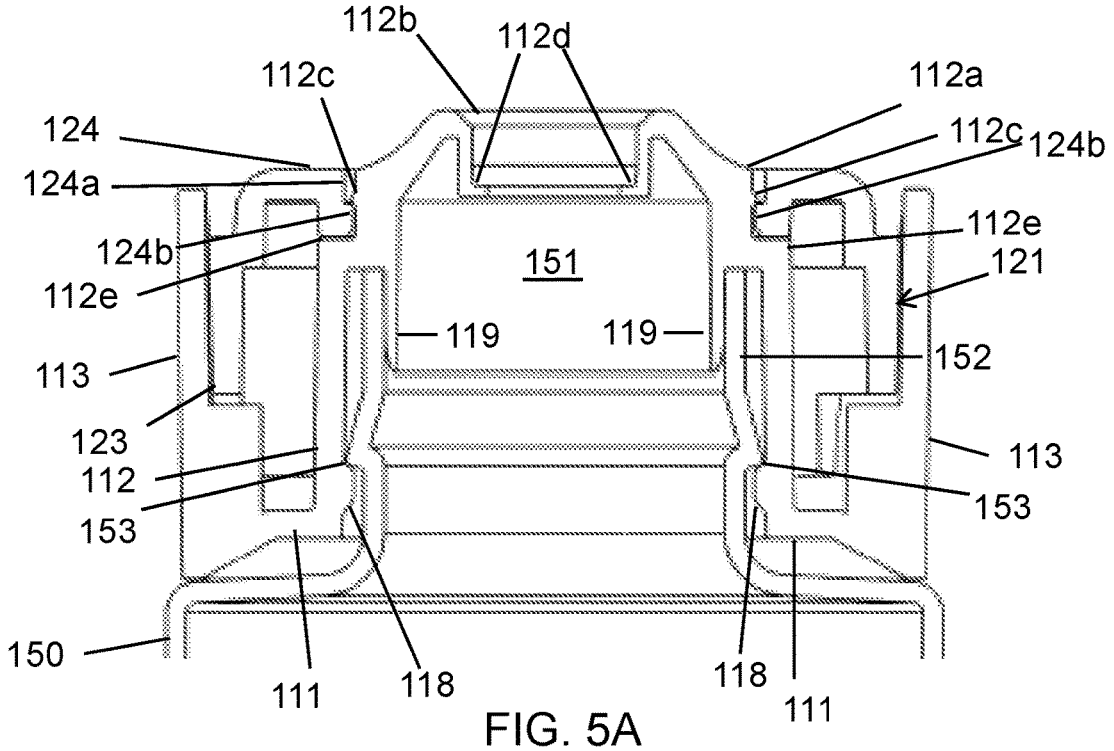
FIG. 5A shows a cross-sectional view of the dispensing container comprising the flip-top closure system in the unlocked and open configuration along axis C-C, in accordance with an embodiment of the present application.
Figure 5B:
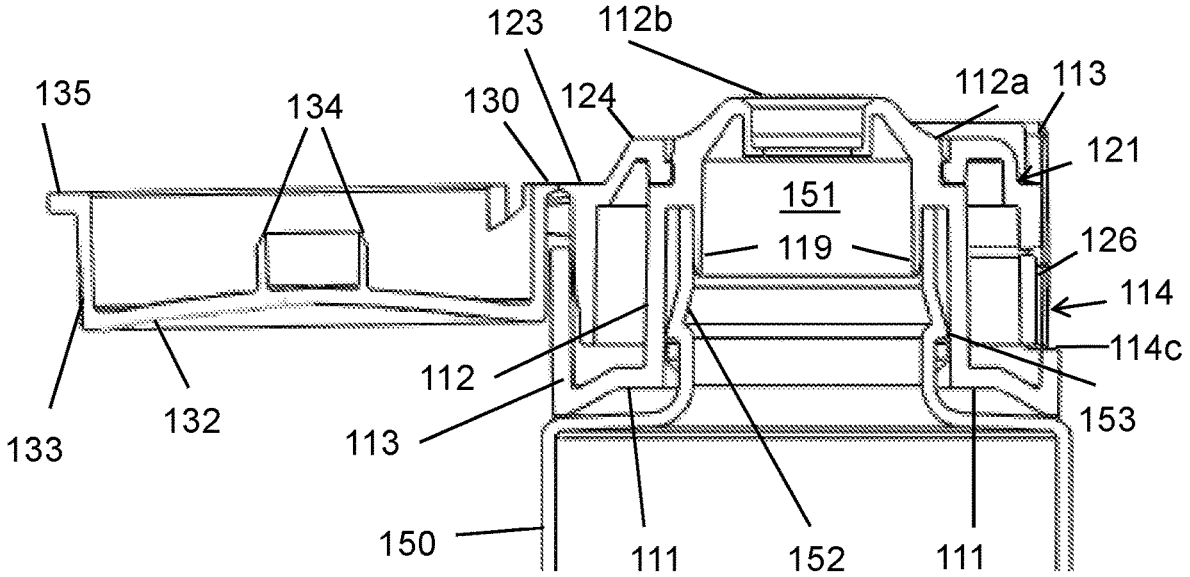
FIG. 5B shows a cross-sectional view of the dispensing container comprising the flip-top closure system in the unlocked and open configuration along axis D-D, in accordance with an embodiment of the present application.

FIGS. 1C and 2C show various views of the closure system 100 and container 150 in the unlocked and open configuration.

When opened, the seal 134 of the lid portion 131 is removed from the through hole 112*b* of the main body 110. A continuous flow passage is formed from the container orifice 151, through the through hole 112*b* in the post 112*a* to allow dispensing the substance of the container 150.

To relock the closure system 100 and container 150, the lid portion 131 can be closed by rotating the lid portion 131 back to reseal the through hole 112*b*, and the axial rotation of the flip-top member 120 can be reversed to reposition the cantilevered tab 125 of the flip-top member 120 within the recess 114 of the closure body member 110. The cantilevered tab 125 is biased outwardly, such that when it is repositioned within the recess 114 of the closure body member 110, it extends back outwardly and the protruding edge 125*a* of the cantilevered tab 125 reengages the vertical edge 114*a* of the recess 114. This locking rotation repositions the tab 135 of the lid portion 131 into the slot 115 of the closure body member 110, at least in part, to prevent reopening of the lid portion 131.

As used herein, directional or positional terms such as "front", "rear", "upper", "lower", "top", "bottom", etc., are used for explanatory purposes only to describe the closure system 100 having the orientation shown on the page for example in FIGS. 1A-1B.

While there have been shown and described and pointed out fundamental novel features of the system as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. A closure system for a dispensing container, comprising:

a body member comprising:

an outer wall comprising a first vertical edge formed in the outer wall and comprising a horizontal slot formed therethrough, and a recess formed in the outer wall adjacent to the first vertical edge; and a hollow passageway formed through the body member; and a rotating closure member comprising:

a lower section configured to be secured to the body member and comprising a central opening and a cantilevered tab comprising a locking edge, which in a locked configuration, abuts a second vertical edge defined by the recess of the body member configured to prevent rotation of the rotating locking member;

an upper section configured to cover the central opening and the hollow passageway in a closed configuration and comprising a protruding tab; and a hinge connecting the lower section and the upper section in a manner that enables opening the rotating closure member to an open configuration;

wherein the protruding tab is at least partly received in the slot of the body member in the locked configuration and the slot prevents vertical movement of the protruding tab and opening of the rotating closure member;

wherein the cantilevered tab is configured to be flexed inwardly to dispose the locking edge within the outer wall of the body member and out of abutment with the second vertical edge to enable the rotation of the rotating closure member in a first axial direction to an unlocked configuration; and wherein in the unlocked configuration, the protruding tab is disposed over the recess and out of the slot of the body member to enable the vertical movement of the protruding tab to open the rotating closure member to the open configuration.

2. The closure system of claim 1, wherein the body member further comprises a post disposed within the outer wall, and wherein the hollow passageway extends through the post.

3. The closure system of claim 2, wherein the post comprises a circumferential bead configured to engage a lip extending from an inner circumferential wall of the central opening of the lower section of the rotating closure member.

4. The closure system of claim 3, wherein the upper section of the rotating closure member further comprises a sealing member configured to engage the post in the closed configuration to seal the hollow passageway.

5. The closure system of claim 4, wherein the body member comprises an inner wall having the post extending therefrom, wherein the inner wall comprises a shoulder adjacent to the post, and wherein the lip on the inner circumferential wall of the central opening of the lower section of the rotating closure member is configured to be engaged between the circumferential bead of the post and the shoulder.

6. The closure system of claim 2, wherein the rotating closure member is configured to be rotated axially about the post approximately 30° between the locked configuration and the unlocked configuration.

7. The closure system of claim 1, wherein the body member comprises an inner wall configured to be removably connected to the dispensing container.

8. The closure system of claim 1, wherein the rotating closure member is configured for rotation in a second axial direction opposite the first axial direction from the unlocked to the locked configuration.

9. The closure system of claim 8, wherein the body member further comprises a plurality of stopping ribs, wherein during rotation of the rotating closure member in the first axial direction, a first edge of the rotating closure member is configured to contact a first of the plurality of stopping ribs to prevent further rotation of the rotating closure member in the first axial direction, and wherein during rotation of the rotating closure member in the second axial direction, a second edge of the rotating closure member is configured to contact a second of the plurality of stopping ribs to prevent further rotation of the rotating closure member in the second axial direction.

10. The closure system of claim 1, wherein the outer wall of the body member further comprises a clearance opposite the recess, and wherein the hinge is disposed in the clearance.

11. The closure system of claim 1, wherein the outer wall of the body member extends around the circumference of the body member.

12. The closure system of claim 1, wherein the cantilevered tab is biased outwardly away from a center of the rotating closure member.

13. The closure system of claim 1, wherein the body member further comprises an inner wall and a gap formed between the outer wall and the inner wall; and wherein the rotating locking member comprises an arm having the cantilevered tab formed thereon configured to be received in the gap.

14. A dispensing container for a substance, comprising:

a closure system, comprising:

a body member comprising:

an outer wall comprising a first vertical edge formed in the outer wall and comprising a horizontal slot formed therethrough, and a recess formed in the outer wall adjacent to the first vertical edge; and a hollow passageway formed through the body member in communication with a chamber of the dispensing container comprising the substance; and a rotating closure member comprising:

a lower section configured to be secured to the body member and comprising a central opening and a cantilevered tab comprising a locking edge, which in a locked configuration, abuts a second vertical edge defined by the recess of the body member configured to prevent rotation of the rotating locking member;

an upper section configured to cover the central opening and the hollow passageway in a closed configuration and comprising a protruding tab; and a hinge connecting the lower section and the upper section in a manner that enables opening the rotating closure member to an open configuration;

wherein the protruding tab is received in the slot of the body member in the locked configuration and the slot prevents vertical movement of the protruding tab and opening of the rotating closure member;

wherein the cantilevered tab is configured to be flexed inwardly to dispose the locking edge within the outer wall of the body member and out of abutment with the second vertical edge to enable the rotation of the rotating closure member in a first axial direction to an unlocked configuration; and wherein in the unlocked configuration, the protruding tab is disposed over the recess and out of the slot of the body member to enable the vertical movement of the protruding tab to open the rotating closure member to the open configuration.

15. The dispensing container of claim 14, wherein the dispensing container comprises a neck configured to be received in the hollow passageway of the body member and comprising an external, circumferential bead, and wherein the body member comprises one or more locking elements configured to engage the circumferential bead on the neck to secure the closure system to the dispensing container.

16. The dispensing container of claim 15, wherein the one or more locking elements are disposed on an inner wall of the body member which is spaced apart from the outer wall of the body member.

17. The dispensing container of claim 16, wherein the body member comprises an annular sealing member disposed within the inner wall that is configured to be received within the neck of the dispensing container.

18. The dispensing container of claim 14, wherein the rotating closure member is configured to be rotated axially about the post approximately 30° between the locked configuration and the unlocked configuration.

19. The dispensing container of claim 14, wherein the rotating closure member is configured for rotation in a second axial direction opposite the first axial direction from the unlocked configuration to the locked configuration.

20. The dispensing container of claim 19, wherein the cantilevered tab is biased outwardly away from a center of the rotating closure member and into the recess upon rotation from the unlocked configuration to the locked configuration.

* * * * *